United States Patent [19]

Pollard

[11] Patent Number: 4,732,487

[45] Date of Patent: Mar. 22, 1988

[54] NON-INTRUSIVE AGITATION OF A FLUID MEDIUM

[75] Inventor: Geoffrey J. Pollard, Bedford, Great Britain

[73] Assignee: The British Hydromechanics Research Association, Beford, Great Britain

[21] Appl. No.: 756,517

[22] PCT Filed: Nov. 26, 1984

[86] PCT No.: PCT/GB84/00404

§ 371 Date: Jul. 8, 1985

§ 102(e) Date: Jul. 8, 1985

[87] PCT Pub. No.: WO85/02352

PCT Pub. Date: Jun. 6, 1985

[30] Foreign Application Priority Data

Oct. 25, 1983 [GB] United Kingdom ..... 8331594

[51] Int. Cl.[4] ..... B01F 11/00

[52] U.S. Cl. ..... 366/112; 366/114; 366/118; 366/289; 366/332; 366/316

[58] Field of Search ..... 366/117–120, 366/276–278, 289, 332, 108, 113, 130, 112, 111, 114, 118

[56] References Cited

U.S. PATENT DOCUMENTS

| | | | |
|---|---|---|---|
| 163,365 | 5/1875 | Nottbeck | 366/112 |
| 2,376,221 | 5/1945 | Baker | 366/118 |
| 2,543,818 | 3/1951 | Wilcox | 366/118 |
| 2,615,692 | 10/1952 | Müller | 259/113 |
| 2,681,798 | 6/1954 | Muller | 366/118 |
| 3,063,813 | 11/1962 | Weinbrenner | 23/252 |
| 3,384,354 | 5/1968 | Migule et al. | 259/99 |
| 4,088,716 | 5/1978 | Stoev | 261/64 |

FOREIGN PATENT DOCUMENTS

| | | |
|---|---|---|
| 912115 | 7/1946 | France . |
| 2197634 | 3/1974 | France . |

*Primary Examiner*—Timothy F. Simone
*Attorney, Agent, or Firm*—Shapiro and Shapiro

[57] ABSTRACT

Impeller means (4 and 5) is provided in a container (2) for agitating fluid. The impeller means is movable to effect fluid flow. The impeller means includes an impeller (4) which is separate from a wall portion of the container to a point of which the impeller (4) is connected by supporting means (5). Movement of the impeller means relative to the wall portion is achieved by making the impeller means flexible. A vibrator (6) may be provided to cause movement of the impeller means. The characteristics of the components can be chosen so that when the vibrator is activated the impeller vibrates with a greater amplitude than the wall portion (3). This can be achieved by vibrating the wall portion at a frequency approximately equal to a resonant frequency of the impeller means.

13 Claims, 9 Drawing Figures

NON-INTRUSIVE AGITATION OF A FLUID MEDIUM

FIELD OF THE INVENTION

The invention relates to apparatus and a method for agitating fluids, for example to effect mixing of two or more fluids without the intrusion of agitating means through the wall of a container enclosing the fluid medium.

BACKGROUND ART

Known apparatus for agitating a fluid medium comprises a container for the liquid medium; and means movable within the container to effect fluid flow. Movement of this means is effected by driving means which may form part of the apparatus. In this apparatus, the means extend between internal and external parts respectively disposed inside and outside the container.

However, there are occasions where it is desirable and/or necessary to intimately mix two or more fluids in a sealed container without any moving parts entering the container enclosing the fluids. Thus, non-intrusive mixing such as this is required where the contents of a sealed container have to be mixed immediately before use. This might arise, for example, when materials that are stored in sealed containers for prolonged periods separate out into their constituent components. Another application would be the mixing of materials that are toxic, explosive or otherwise dangerous when in contact with air. The mixing apparatus would then have to operate in such a way as to avoid any sealing problems inherent in conventional mixing apparatus involving the use of impellers.

DISCLOSURE OF THE INVENTION

It is the object of the present invention to provide a method and apparatus for this non-intrusive mixing as hereinbefore described.

According to the invention, there is provided apparatus for agitating a fluid medium, for example: to effect mixing of two or more fluids, comprising a container for the fluid medium and impeller means located within the container and movable to effect fluid flow. The container has a wall portion and the impeller means comprises an impeller separate from the wall portion and supporting means connecting the impeller to a point on the wall portion, the impeller means being flexible such that a point on the impeller is movable relative to said point on the wall portion. The movement of the impeller means for its flexibility is a useful arrangement to effect fluid flow. Flexing of the impeller means can be caused for example by shaking the container as a whole or by connecting a vibrator to said wall portion, the characteristics of the vibrator, the wall portion and the impeller means being chosen so that when the vibrator is activated, the impeller vibrates with a greater amplitude than the wall portion. This can be achieved by arranging for the frequency of vibration of the wall portion to be approximately equal to a resonant frequency of the impeller means, not necessarily the lowest resonant frequency of the impeller means.

In another aspect, the invention provides a method of agitating a fluid medium in a container which has a wall portion on which flexible impeller means is mounted within the container, the impeller means comprising an impeller separate from the wall portion and supporting means connecting the impeller to a point on the wall portion, the method comprising causing the impeller means to flex such that a point on the impeller moves relative to said point on the wall portion.

Examples of the invention will now be described with reference to the accompanying drawings in which.

Figure 1:
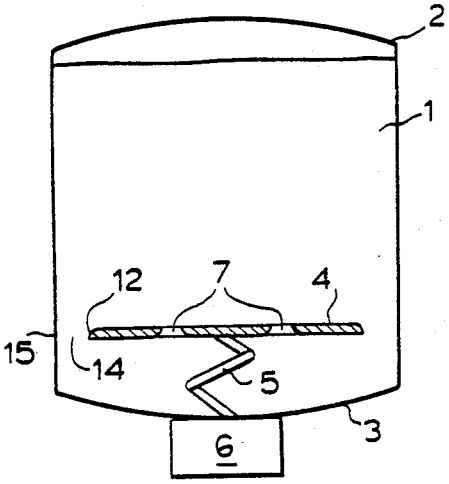
FIG. 1 is a central section through agitation apparatus.
Figure 2:
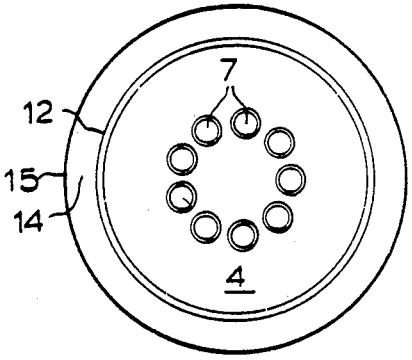
FIG. 2 is a plan of the apparatus of FIG. 1.

Referring to FIGS. 1 and 2, a fluid medium 1 to be agitated is held in a container 2 having a bottom wall portion 3. An impeller plate 4 is separate from the wall portion 3 and supported from the centre thereof by a supporting spring 5 at its centre. The plate 4 is provided with a plurality of holes 7 arranged in a circle on the plate 4 as can best be seen from FIG. 2. Each hole is bevelled so as to provide greater resistance to fluid flow therethrough in the downward direction than in the upward direction. The rim 12 of the plate 4 is bevelled in the opposite direction to the holes 7, so that the annular region 14 between the rim 12 and the side wall 15 of the container presents a greater resistance to upward fluid flow than downward fluid flow. Thus, when the plate 4 is oscillated vertically, fluid will tend to flow upwardly through the holes 7 and downwardly through the region 14, thus circulating within the container 2 to effect mixing.

When the container 2 is small, it may be possible to effect this mixing by shaking the container, causing flexing of the plate 4 and spring 5 combination to cause circulation of the fluids, but when the container is of large size, such as 200 liters capacity, then a vibrator 6 applied to the bottom wall portion 3 is a more convenient method of causing flexing of the impeller assembly. Vibrations are transmitted through the wall portion 3 to cause the impeller plate 4 to vibrate relative to the point of attachment of the spring 5 to the wall portion 3.

The motion of the plate 4 will depend on the effective masses and stiffnesses of the bottom wall portion 3, the spring 5 and the plate 4, together with the damping characteristics of the fluid or fluids in the container and the frequency of vibration applied by the vibrator 6. The frequency of vibration is preferably chosen to cause maximum amplitude of vibration of the impeller plate 4 (in order to achieve maximum agitation of the fluid) in relation to a given amplitude of vibration of the wall portion 3 (which is kept as small as possible in order to avoid failure of the wall portion 3). This frequency can be selected by experiment but it is believed to occur when the frequency of vibration of the wall portion 3 is approximately equal to a resonant frequency of the combination of the impeller 4 and supporting spring 5, these resonant frequencies depending on the effective stiffness of the supporting spring 5 and the effective mass of the impeller plate 4. The current theoretical understanding of this relationship is presented below.

Figure 3:
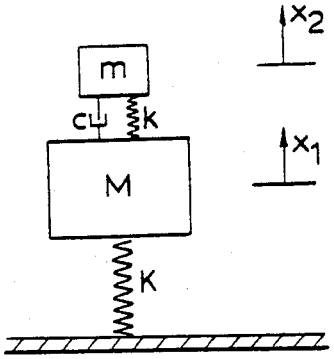
FIG. 3 is a schematic diagram of agitation apparatus to indicate the symbols used in the theory of operation.

The wall portion 3 will have associated with it an effective mass, M, and an effective stiffness, K, which together govern its natural frequency, $\Omega$, since $\Omega=(K/M)^{\frac{1}{2}}$. Similarly, the impeller means comprising the impeller 4 and the supporting means 5 has associated with it an effective mass, m, and an effective stiffness, k, which together govern its natural frequency, $w_n=(k/m)^{\frac{1}{2}}$. An alternating force of frequency w acts on the wall portion 3—let the amplitude of this force be denoted as F. Since the impeller 4 vibrates relative to the wall portion 3 through the fluid medium 2 it will experience a damping force—let this be represented by a viscous damping constant, c. Then as illustrated in FIG. 3, the combined system comprising the wall portion 3 and the impeller means comprising the impeller 4 and the supporting means 5 may be represented as a spring of stiffness K attached to a rigid foundation, a mass M attached to this spring and acted on by a force of amplitude F and frequency w, a spring of stiffness k and dashpot of damping constant c both attached to this mass and a second mass, m, attached to both the spring of stiffness k and the dashpot of damping constant c.

Denoting the displacement of the mass M by $x_1$ and that of the mass m by $x_2$, the equations of motion of the two masses may then be written as $$-M\ddot{x}_1-Kx_1+k(x_2-x_1)+c(\dot{x}_2-\dot{x}_1)+Fe^{iwt}=0 \quad (1)$$

$$-m\ddot{x}_2-k(x_2-x_1)-c(\dot{x}_2-\dot{x}_1)=0 \quad (2)$$

The displacements $x_1$, $x_2$ will also be alternating with the same frequency, w, as the force F—let their amplitudes be denoted as $x_{10}$ and $x_{20}$, respectively and their phase angles as $B_1$ and $B_2$, respectively. Thus $$x_1 = x_{10}\,e^{i(wt+B1)} \quad x_2 = x_{20}e^{i(wt+B2)}$$

differentiating $$\dot{x}_1 = iwx_1 \quad \dot{x}_2 = iwx_2$$

and differentiating again $$\ddot{x}_1 = -w^2x_1 \quad \ddot{x}_2 = -w^2x_2$$

Substituting these expressions for $x_1$, $x_2$, $\dot{x}_1$ and $\dot{x}_2$ into equations (1) and (2), $$-Mw^2x_1+Kx_1+k(x_2-x_1)+iwc(x_2-x_1)=Fe^{iwt} \quad (1a)$$

$$-mw^2x_2+k(x_2-x_1)+iwc(x_2-x_1)=0 \quad (2b)$$

Collecting terms in $x_1$ and $x_2$ $$[-Mw^2+K+k+iwc]x_1-[k+iwc]x_2=Fe^{iwt} \quad (1c)$$

$$-[k+iwc]x_1+[-mw^2+k+iwc]x_2=0 \quad (2c)$$

Equation (2c) yields an expression for $x_2$ in terms of $x_1$ and other variables which, when substituted into (1c) gives as an expression for $x_1$ $$x_1\left[-Mw^2+K+k+iwc-\frac{(k+iwc)^2}{(-mw^2+k+iwc)}\right]=Fe^{iwt}$$

This expression may be re-written as $$\frac{x_1}{Fe^{iwt}}= \quad (3)$$

-continued $$\frac{K-mw^2+iwc}{(-Mw^2+K)(-mw^2+k)-mw^2k+iwc(-Mw^2+K-mw^2)}$$

Equation (2c) may also be used to yield an expression for $x_1$ in terms of $x_2$ and other variables which, when substituted into (1c) leads to an expression for $x_2$, as $$\frac{x_2}{Fe^{iwt}}= \quad (4)$$

$$\frac{k+iwc}{(-Mw^2+K)(-mw^2+k)-mw^2k+iwc(-Mw^2+K-mw^2)}$$

Since high $x_2$ is required for effective mixing and low $x_1$ for long lifetime of the wall portion, it is convenient to consider their ratio $$\frac{x_2}{x_1}=\frac{k+iwc}{K-mw^2+iwc}$$

Remembering that $w_n=(k/m)^{\frac{1}{2}}$ and introducing the critical damping constant, $c_c=2\,mw_n$, this may be re-written as $$\frac{x_2}{x_1}=\frac{1+\frac{2iwc}{w_nc_c}}{1-\frac{w^2}{w_n^2}+\frac{2\,iwc}{w_nc_c}}$$

This expression implies an amplitude ratio $x_{20}/x_{10}$ given by $$\left(\frac{x_{20}}{x_{10}}\right)^2=\frac{1+\frac{4w^2c^2}{w_n^2c_c^2}}{(1-w^2/w_n^2)^2+\frac{4w^2c^2}{w_n^2c_c^2}} \quad (5)$$

The expression for the amplitude ratio shows that $x_{20}/x_{10}$ becomes large for w close to $w_n$, i.e. when the natural frequency of the impeller means comprising the impeller (4) and the supporting means (5) is close to the frequency of vibration of the wall portion (3). It is important to note that this ratio is independent of the effective mass, M, and stiffness, K, of the wall portion 3. Equations (3) and (4) show that the absolute values of $x_1$ and $x_2$ respectively are dependent on M and K: their ratio, $x_2/x_1$, however remains independent of these parameters.

Equation (5) shows that, because of the term $$4w^2c^2/w_n^2c_c^2,\ x_{20}/x_{10}$$

in fact reaches a peak for w slightly lower than $w_n$. However, since $c/c_c$ is in general small, a reasonable estimate of the peak value of $x_{20}/x_{10}$ may be made by setting $w=w_n$ in the equation, when it is found that $$\left(\frac{x_{20}}{x_{10}}\right)^2=\frac{1+4c^2/c_c^2}{4c^2/c_c^2} \quad (6)$$

or

-continued $$\left(\frac{x_{20}}{x_{10}}\right)^2 = \left(\frac{c_c}{2c}\right)^2 \text{ for small } c/c_c \tag{6a}$$

Equation (6) shows that the peak value of $x_{20}/x_{10}$ depends on the damping ratio $c/c_c$ and since the damping ratio is generally small, a large amplitude ratio may be achieved at w close to $w_n$. This is the main result sought by the theoretical presentation.

As an illustration of typical amplitude ratios that might be realized; consider damping ratios of $c/c_c=0.05$ (representing quite high damping) and $c/c_c=0.0125$. The former value in Equation (6) gives $x_{20}/x_{10}=10.05$, the latter a ratio of $x_2/x_1=40.01$.

The theory may then be taken a stage further when it is remembered that the power P delivered to the fluid by the plate is given by $$P = cw_n^2x_{20}^2/2 \tag{7}$$

and that effective mixing requires P to be high. Since the damping constant c depends on the size and geometry of the impeller, it is open to choice in the design. Thus, a given power input may be achieved either by a relatively high c and low $x_{20}$ or a low c and a high $x_{20}$. Equation (6a) shows that assuming $x_{10}$ is fixed by consideration of stresses in the container wall, high c implies low $x_{20}$ and vice versa. In fact, when Equations (6a) and (7) are combined, it is found that $$P = (k^2/2c)x_{10}^2$$

suggesting that c should be contrived to be as low as possible.

To summarize the results of the theoretical discussion, it has been shown that to maximise the ratio of the amplitude of vibration of the impeller 4 to that of the wall portion 3, the frequency of vibration of the wall portion 3 should be close to the natural frequency of the impeller means comprising the impeller 4 and the supporting means 5 (or more precisely, the frequency of vibration should be such as to produce a maximum ratio of $x_{20}/x_{10}$ as given in Equation (5)). The actual value of this maximum ratio $x_{20}/x_{10}$ can be adjusted by varying the damping ratio $c/c_c$ of the impeller 4, which will be a function of its size and geometry. The absolute values of $x_{10}$ and $x_{20}$ may then be set by varying the stiffness K and mass M of the wall portion according to Equations (3) and (4), respectively.

Figure 4:
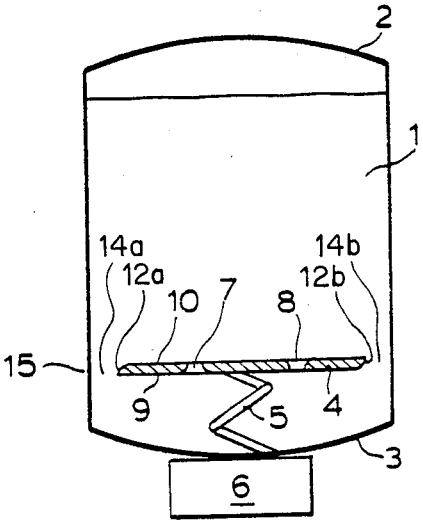
FIGS. 4 and 5 are central sections of modified agitation apparatuses.

FIG. 4 shows an alternative plate 4 formed with a first type of aperture which presents a lower resistance to flow from one side of the plate to the other side of the plate than to flow from said other side of the plate to said one side of the plate and a second type of aperture which presents a lower resistance to flow from said other side of the plate to said one side of the plate than to flow from said one side of the plate. In this embodiment, the circumferential edge of the plate is (optionally) shaped such that half of the annular hole formed by said edge and the container wall presents a lower resistance to flow from one side of the plate to the other side of the plate than to flow from said other side of the plate to said one side of the plate. The other half of said hole presents a lower resistance to flow from said other side of the plate to said one side of the plate than to flow from said one side of the plate to said other side of the plate.

In FIG. 4, the circular plate 4 has a concentric ring of holes 7 and 8. The holes 7 on one side of a diameter have greater resistance to fluid flow downwardly through the plate 4 than to upward flow. The holes 8 on the other side of the diameter are oppositely oriented. The rim portion 12*a* of the plate 4 on the first side of the diameter is bevelled to present greater resistance to upward flow than to downward flow and the rim portion 12 of on the opposite side is oppositely oriented, as shown. When the plate 4 has vibrations applied from the vibrator 6 through the wall 3 and the spring support 5, fluid will tend to flow down through the half-annular gap 14*a* and up through the holes 7, down through the holes 8 and up through the half-annular gap 14*b*, ensuring good mixing of fluid.

Figure 5:
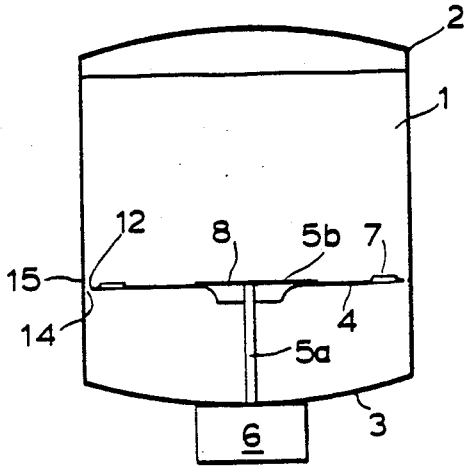
Figure 6:
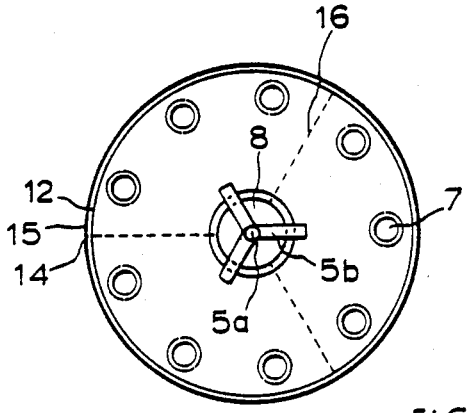
FIG. 6 is a plan of the apparatus of FIG. 5, and FIGS. 7, 8 and 9 represent frequency responses of the base wall portion and the impeller plate to the applied vibration.

In the embodiment of FIGS. 5 and 6, the support comprises a substantially rigid stem 5*a*, but the stem 5*a* is connected to the plate 4 by three equi-spaced spring leaves 5*b* to allow the plate to vibrate transversely to its plane. It would be possible for the plate 4 itself to flex, if this were found preferable to the flexing of the support stem 5 or the provision of the spring leaves 5*b*. A practical example of this embodiment will now be described.

A 600 mm diameter mixing vessel 2 containing a process fluid 1 has a dished base portion 3 and is provided with an electromagnetic vibrator 6 which operates at frequency of 100 Hz. The dished base portion 3 has an effective stiffness of $K=2.05\cdot10^8$ $Nm^{-1}$ and an effective mass, including the vibrator 6, of M=40.0 kg and so has a natural frequency of $Fn=\Omega_n/2\pi$ of approximately 360 Hz. A plate 4 is connected to the dished base portion 3 by supporting means 5*a* and 5*b* which consists of a rigid vertical member 5*a* and flexible horizontal strips 5*b* so as to allow vertical movement of the plate 4 while preventing significant lateral movement of the plate 4. Radial cuts 16 in the plate 4 enable it to move vertically on the strips 5*b* without generating significant stiffness forces in the plate. The plate 4 is provided with nine first apertures 7 equiangularly spaced around a 500 mm diameter pitched circle centred on the centre of the plate. The apertures are bell-mouthed so as to converge from the lower to the upper side of the plate 4, each having a smaller diameter of 40 mm and a larger diameter of 60 mm plate 4 is also provided with a single central aperture 8 which is bell-mouthed so as to converge from the upper to the lower side of the plate 4, having a smaller diameter of 120 mm and a larger diameter of 180 mm. The outer diameter of the plate 4 is 590 mm so that the flow through the annular aperture 14 bounded by the rim 12 of the plate 4 and the wall 15 of the container 2 is insignificant. The effective stiffness of the horizontal strips 5*a* is $k=7.90\times10^5$ $Nm^{-1}$ and the effective mass of the plate 4 is m=2.0 kg so that the natural frequency of the impeller means comprising the plate 4 and the supporting means 5*a* and 5*b* if $f_n=(w_n/2\pi)=100$ Hz and so is equal to the frequency of operation of the vibrator 6. The damping ratio, $c/c_c$, of the plate 4 in the process fluid is $c/c_c=0.025$.

The maximum safe amplitude, $x_{10}$, of vibration of the base portion 3 to avoid fatigue failure is in this case approximately 0.25 mm. The amplitude ratio, $x_{20}/x_{10}$, achievable with the damping ratio quoted is $x_{20}/x_{10}=20.02$, giving a maximum allowable amplitude of vibration of the impeller of approximately $x_{20}=5.0$ mm. With this amplitude and frequency of vibration and with the quoted damping constant c, the power input P to the process fluid 1 is found to be P=310 watts, sufficient to provide very effective mixing.

Figure 7:
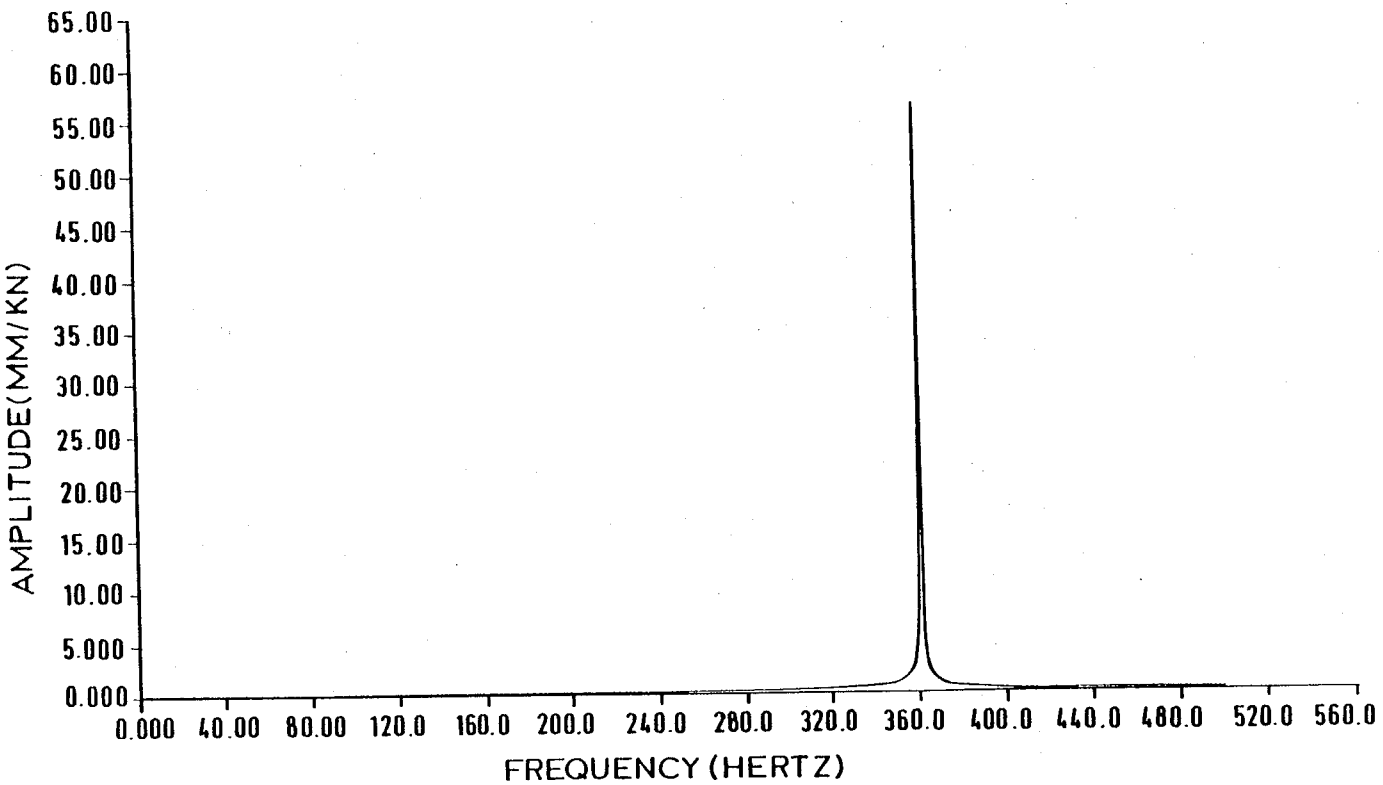
Figure 8:
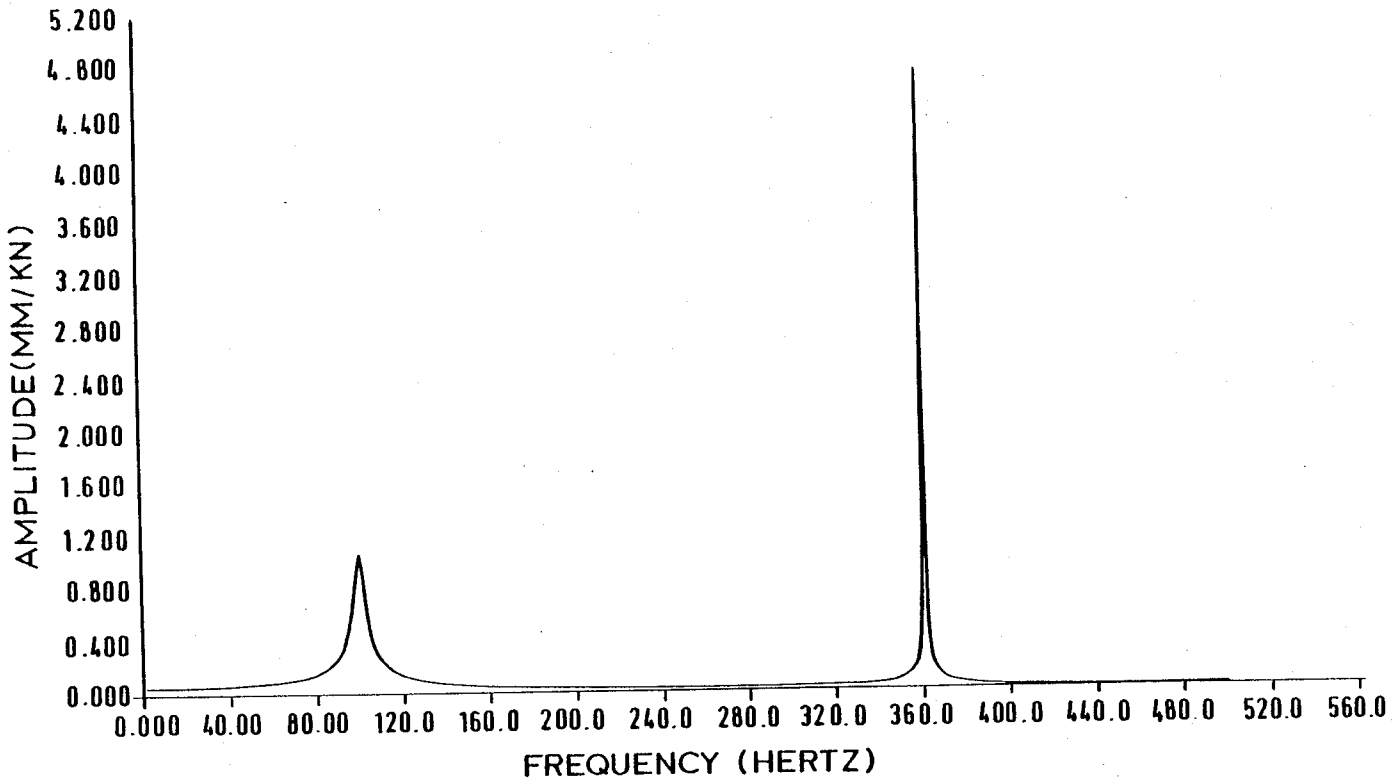
Figure 9:
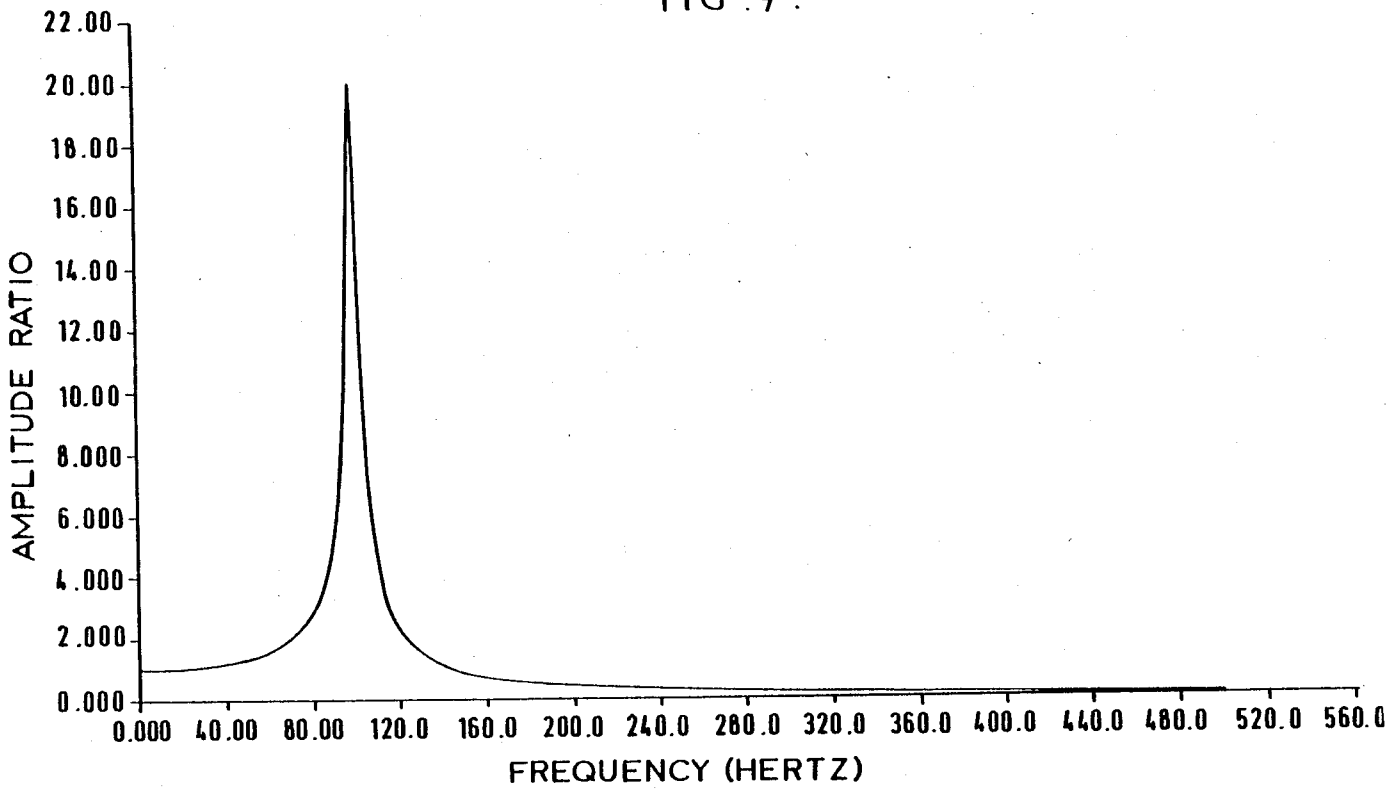

The frequency responses of the base portion 3 and the impeller plate 4 and the amplitude ratio $x_{20}/x_{10}$ are as set out in Equations (3), (4) and (5) respectively and are presented graphically in FIGS. 7, 8 and 9 respectively. The amplitudes $x_{20}$ and $x_{10}$ at 100 Hz are found to be 1.0603 mm/kN and 0.0529 mm/kN respectively. In order to generate the required amplitudes of $x_{20}=5.0$ mm and $x_{10}=0.25$ mm, a driving force must be provided by the vibrator 6 with an amplitude F given by $$F=5.0/1.060=0.25/0.0529 \text{ kN}$$

or $$F=4700\text{N}$$

The motion of the impeller 4 and/or the wall portion 3 can be detected and used to control an active element which either changes dynamically the spring-mass characteristics of the impeller means comprising the plate 4 and the supporting means 5 or exerts an additional force on the wall portion 3. By these means, the ratio of the amplitude of the impeller 4 to that of the wall portion 3 may be better controlled compared to the case where no active element is used.

The plate 4 can be instrumented for any of a wide range of variables such as acceleration, temperature and flow rate through the apertures. Such variables could be used as a means of deducing the properties of the fluid under mix. Optionally, the fluid properties to deduced could be used as means of controlling the processes taking place within the vessel. Where motion of the plate is used as a means of deducing fluid properties, it may be necessary to measure the movement of the wall portion 3 as well. The detector for controlling the active element and the instruments can be connected to the exterior of the container by leads in a bore of the support 5, thus avoiding entry into the fluid under mix.

In the previously described embodiments, the frequency of vibration of the wall portion 3 has been chosen in order to achieve a maximum ratio of the amplitude of vibration of the plate 4 to that of the wall portion 3. When the ratio is unity, the plate 4 and the wall portion 3 vibrate in synchronism and there is no change in dimensions of the supporting means 5. This arrangement is described in our earlier application No. PCT/GB84/00102. The present invention covers other arrangements, e.g., where the amplitude ratio is greater than one, and also where the amplitude ratio is negative, so that the plate 4 and the wall portion 3 vibrate in antiphase. The supporting means 5 will flex to allow this antiphase vibration and the relative movement will cause considerable agitation of the fluid. The optimum frequency for this purpose can be selected by experiment, but is believed to occur when the frequency of vibration of the wall portion 3 is approximately equal to the higher (out of phase) natural frequency of the two-degree-of-freedom system comprising the wall portion 3 and the impeller means comprising the impeller 4 and the supporting means 5 which is illustrated in FIG. 1 and the theory of which was discussed above. The relative motion of the plate 4 and the wall portion 3 can be found by subtracting Equation 3 from Equation 4 above and the frequency should be selected so that the difference is a maximum.

Although the embodiments described above have been concerned with the mixing of fluid in a closed container, it would be possible to operate in a open container, and further to provide an inlet and an outlet for the container so that it can be used for continuous mixing.

The support 5 and the impeller 4 could be provided as an add-on assembly to be fitted into a container. This might for example be connected to the existing lid of a container which would act as the wall portion 3. As an alternative the support 5 and the impeller 4 could be connected to a second lid which would act as the wall portion 3 and which would replace the existing lid when mixing of the container contents is required.

What is claimed is:

1. Apparatus for non-intrusive agitation of a fluid medium, such as to effect mixing of two or more fluids, comprising a container for the fluid medium, impeller means disposed within said container for effecting fluid agitation, said impeller means including an impeller spaced from a wall portion of said container and support means having a point of attachment to said impeller and extending from said impeller to an end of said support means which is attached to said wall portion, said support means thereby supportingly connecting said impeller to said wall portion, said impeller means having flexibility such that portions of said impeller are movable relative to said wall portion to effect said fluid agitation, and a vibrator unit placed externally against said wall portion of said container and operable to impart vibrations to said wall portion of said container, said vibrations being transmitted by said wall portion to said support means and thereby vibrating said impeller and effecting said fluid agitation.

2. Apparatus as claimed in claim 1, wherein the characteristics of the impeller means are chosen so that when the vibrator unit is activated the impeller vibrates with a greater amplitude than the wall portion.

3. Apparatus as claimed in claim 1, wherein said vibrator unit vibrates said wall portion at a frequency approximately equal to a resonant frequency of the impeller means.

4. Apparatus as claimed in claim 1, wherein the impeller is a plate.

5. Apparatus as claimed in claim 1, wherein the impeller is provided with at least one aperture.

6. Apparatus according to claim 5, in which each aperture presents a lower resistance to flow therethrough in one direction than to flow therethrough in an opposite direction.

7. Apparatus according to claim 5, in which a first aperture presents a lower resistance to flow from one side to the other side of the impeller than to flow from said other side to said one side of the impeller and a second aperture presents a lower resistance to flow from said other side to said one side of the impeller than to flow from said one side to said other side of the impeller.

8. Apparatus according to claim 1, comprising sensor means to detect motion of at least one of the impeller and the wall portion.

9. Apparatus as claimed in claim 8, wherein the support means has a hollow bore containing signal leads running from said sensor means to the exterior of the container.

10. Apparatus as claimed in claim 8, wherein said vibrator unit is responsive to an output of said sensor means.

11. Apparatus according to claim 6, wherein a rim of the impeller is shaped so that an aperture bounded by said rim and a wall of said container presents a lower resistance to flow therethrough in said opposite direction than in said one direction.

12. Apparatus according to claim 6, wherein a rim of said impeller and a wall of said container define an annular aperture surrounding said impeller, wherein one half of said rim is configured to present a lower resistance to fluid flow through said annular aperture in said one direction than in said opposite direction, and wherein another half of said rim is configured to present a lower resistance to flow through another half of said aperture in said opposite direction than in said one direction.

13. Apparatus as claimed in claim 1, wherein said container is a closed, sealed container.

* * * * *